United States Patent [19]

Peekna

[11] 4,182,472

[45] Jan. 8, 1980

[54] CONTACTLESS TURNING GUIDE FOR RUNNING WEBS

[75] Inventor: Andres Peekna, Green Bay, Wis.

[73] Assignee: W. R. Grace & Co., New York, N.Y.

[21] Appl. No.: 924,160

[22] Filed: Jul. 13, 1978

[51] Int. Cl.[2] ..... B65H 27/00; B65H 17/32

[52] U.S. Cl. ..... 226/97; 226/196; 242/76

[58] Field of Search ..... 226/97, 95, 91, 93, 226/196, 200, 118, 119; 242/76, 195, 182, 183, 184, 185

[56] References Cited

U.S. PATENT DOCUMENTS

| | | | |
|---|---|---|---|
| 2,736,106 | 2/1956 | Offen | 226/97 X |
| 3,122,295 | 2/1964 | Davison et al. | 226/95 X |
| 3,405,855 | 10/1968 | Daly et al. | 226/97 X |
| 3,521,802 | 7/1970 | Bossons | 226/97 |

*Primary Examiner*—George F. Mautz
*Attorney, Agent, or Firm*—James E. Nilles

[57] ABSTRACT

A guide for contactless support of a running web as the latter changes directions. The guide is formed as a drum-like member having an arcuately curved surface which can be variable as to the length of its arc depending on the degree of turn or change of direction desired for the running web. A series of parallel grooves are formed in the arcuate surface of the drum-like member, which grooves extend in the direction of web travel. An air nozzle extends along the length of the drum-like member and at each end of the grooves in the drum-like member and pressurized air is fed through the nozzles so as to form a pneumatic cushion between the web and the arcuate surface of the drum-like member to thereby float the web in its turning direction over the drum-like member and without contact therewith. The grooves in the arcuate surface act as labyrinth seals in inhibiting transverse air flow out of the cushion and towards the edges of the running web. A barrier extends transversely of the direction of the web travel and across the grooves and blocks them intermediate their length to thereby form a barrier to the air flow in the grooves. This barrier ensures flow stability by preventing one slot from dominating the other which would lead to a non-symmetrical air flow pattern and reduced cushion pressure as well as result in non-uniform cushion pressure.

7 Claims, 8 Drawing Figures

CONTACTLESS TURNING GUIDE FOR RUNNING WEBS

BACKGROUND OF THE INVENTION

Various devices for forming fluid cushions or fluid bearings have been proposed for the contactless support of a web as the latter changes directions during its course of travel. These webs may have printed matter on both sides and which must be dried without contact of the web by any supporting rollers or the like. These running webs to be dried must pass through a number of runs of different directions and the web must be held out of contact with anything until the ink has dried. These contactless supporting devices have a generally partially cylindrical surface through which pressurized air is introduced through various slots, holes, or apertures, or other designs or patterns.

Examples of such prior art devices are shown in the Daniels U.S. Pat. No. 2,689,196 which issued Sept. 14, 1954 wherein a series of holes are simply formed in the cylindrical surface for the passage of pressurized air therethrough to support and guide a web passing over the drum. Another example is shown in the U.S. Pat. No. 3,097,971 to Carlisle which issued July 16, 1963 and which has a series of slits in the curved supporting surface and which extend either longitudinally or transversely to the web, or both. Air under pressure is then passed through these slits to form a cushion between the drum and the web. Still another example is shown in the U.S. Pat. No. 3,567,093 which issued Mar. 2, 1971 to Johnson and wherein a series of holes is formed in the drum-like supporting member and a series of arcuate baffle members extend around a portion of the drum and in the direction of web movement. Still other examples of the prior art are shown in U.S. Pat. No. 3,127,080 issued Mar. 31, 1964 to Allander et al and U.S. Pat. No. 3,186,326 which issued June 1, 1965 to Schmidt and in both of the latter patents, air is passed through slots of holes in the cylindrical members to form a pressurized cushion between the cylindrical member and the web.

One shortcoming of the prior art devices of the general type to which this invention pertains is the fact that the cushion of air between the web and the drum is dissipated, usually along the opposite edges of the web or the pressure cushion is otherwise not maintained uniform across the width of the web and particularly at the edges of the web where the pressure tends to fall off to an extent that the web edges are not adequately supported. Another problem of the prior art devices is that excessive horsepower was required to provide the necessary air flow and excessive air flow was required for adequate contactless support of the web during operation.

SUMMARY OF THE INVENTION

The present invention provides a contactless support for a running web in which an arcuate surface is provided and which has a series of parallel grooves in its periphery and that extend in the direction of web travel. The contactless support provided by the present invention also includes a pair of air nozzles extending longitudinally of the support member, that is transversely across the web, one such nozzle being located adjacent each of opposite ends of the parallel grooves. The air nozzles act to supply pressurized air to the space between the web and the arcuate surface of the support thereby supporting the web in a contactless manner by the pressurized cushion of air. The parallel grooves which are formed in the support surface act as labyrinth seals to inhibit the transverse movement of air towards the edges of the running web. The particular groove pattern provided by the present invention requires considerably less air flow and air horsepower than conventional arcuate surfaces of the prior art devices, to support the running web in a contactless manner and without marking of the web. The arrangement is such that when a web is in moderate to close clearance relationship with the grooved surface of the support, labyrinth seals are created which inhibit transverse air flow from out of the edges of the web.

A more limited aspect of the invention relates to a barrier which extends transversely of the direction of the web travel and across the grooves and blocks them intermediate their length to thereby form a barrier to the air flow in the grooves. This barrier ensures flow stability by preventing one slot from dominating the other which would otherwise lead to a non-symmetrical air flow pattern and reduced cushion pressure as well as result in non-uniform cushion pressure.

Generally, the present invention provides a contactless turning support for a running web in which an arcuate surface has a plurality of parallel grooves in its surface which act as labyrinth seals to provide transverse leakage of air from the air cushion from between the web and the arcuate support.

These and other objects and advantages of the present invention will appear hereinafter as this disclosure progresses, reference being had to the accompanying drawings.

DESCRIPTION OF A PREFERRED EMBODIMENT

Figure 2:
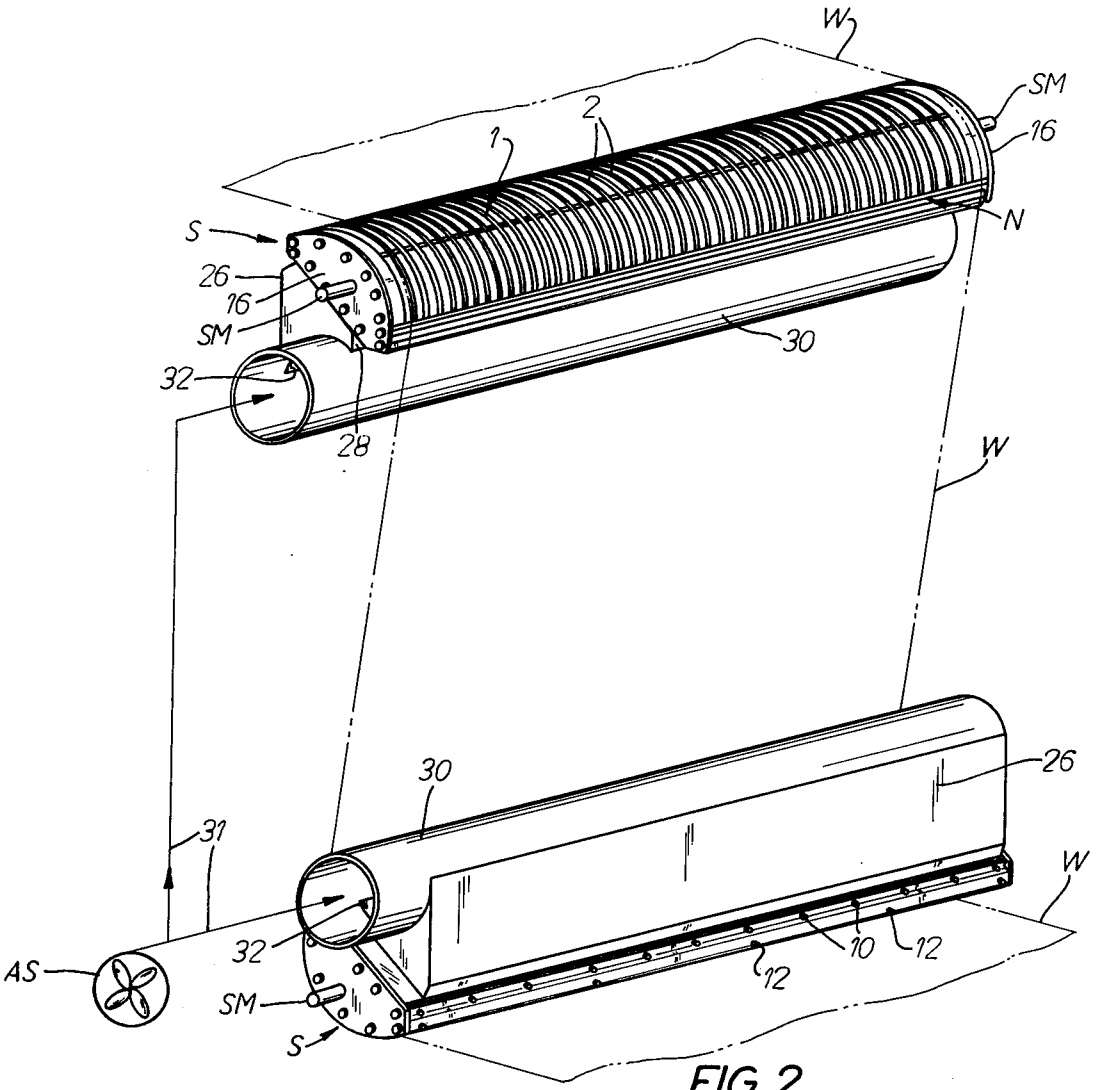
FIG. 2 is a perspective view of a pair of contactless supports made in accordance with the present invention and as shown schematically in FIG. 1.
Figure 1:
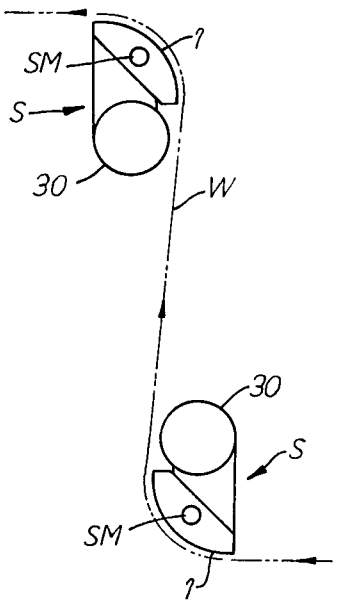
FIG. 1 is a schematic, elevational view of a web being supported by a pair of contactless supports made in accordance with the present invention.

The web support provided by the present invention can support a running web through various degrees of turning movement, but the present invention has been illustrated as showing a web support for an approximate 90 degree turn of the running web. Such a turning movement is shown in FIG. 1 wherein the web W passes over and without contact with the support S provided by the present invention.

Figure 6:
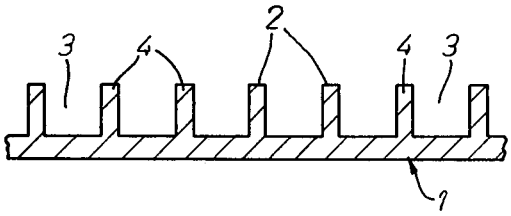
FIG. 6 is a transverse cross-sectional view, taken generally along the line 6—6 in FIG. but on an enlarged scale.

The support S includes a member 1 formed generally with a 90 degree arcuate surface 2 which extends across the width of the web W to be supported and preferably beyond the edges of the web. The support S has shaft means SM by which it is mounted in the machine frame FM. A series of parallel grooves 3 are formed in the surface of the arcuate member 1 and extend in the direction of web travel, terminating at 3*a* at one end and at 3*b* at the other end. As shown in FIG. 6, the grooves 3 are generally rectangular in cross-sectional shape and form circumferential ribs 4 and also define the upper surface 2 of arcuate form for the support. In operation, the web W passes a distance away from the surface 2, for example on the order of ⅛ inch, between the web and the slotted surface 2. An air nozzle N is located along each of the ends of the grooves 3 and these nozzles extend the full width of the support S; namely, they extend transversely across the width of the web supported by the contactless support S. The nozzles are formed by a generally U-shaped piece of metal having a sharp nozzle edge 6 which is spaced a distance from the support 1 so as to define an elongated slot or nozzle 8 through which pressurized air is discharged. The nozzle N is held on the frame F of the support by a series of screws 10 at the rear end of the nozzle and also by adjustable screws 12 which are threadably engaged in the frame F and extend freely through the nozzle N so as to adjust the size of the nozzle opening 8. The arcuate support S is rigidly secured to the frame member F by the screws 14 and 15 which facilitate the manufacture and assembly of the various parts. Alternatively, the nozzle N and the frame F may be all one piece of metal, formed by extrusion, for example.

The support S includes end plates 16 secured by cap screws 17 to the ends of the arcuate member 1. Stub shaft means SM are welded to and extend from the end plates and are adjustably mounted in the frame means FM. The angular position of the support can thus be changed by adjustably rotating the support on its stub shafts.

The frame F has a series of holes 20 passing therethrough and through which pressurized air is fed from the chamber 24. Chamber 24 is also defined by sheet metal members 26 and 28 that in turn are welded to a central duct 30. Air under pressure is supplied to the end of the duct 30 by a supply conduit 31 from an air supply AS. The duct 30 has a longitudinal opening 32 and in this manner, pressurized air passes from duct 30 and into the chamber 24, and is readily available for discharge through the nozzle N and to each of the ends of the parallel grooves in the arcuate surface 2.

Figure 3:
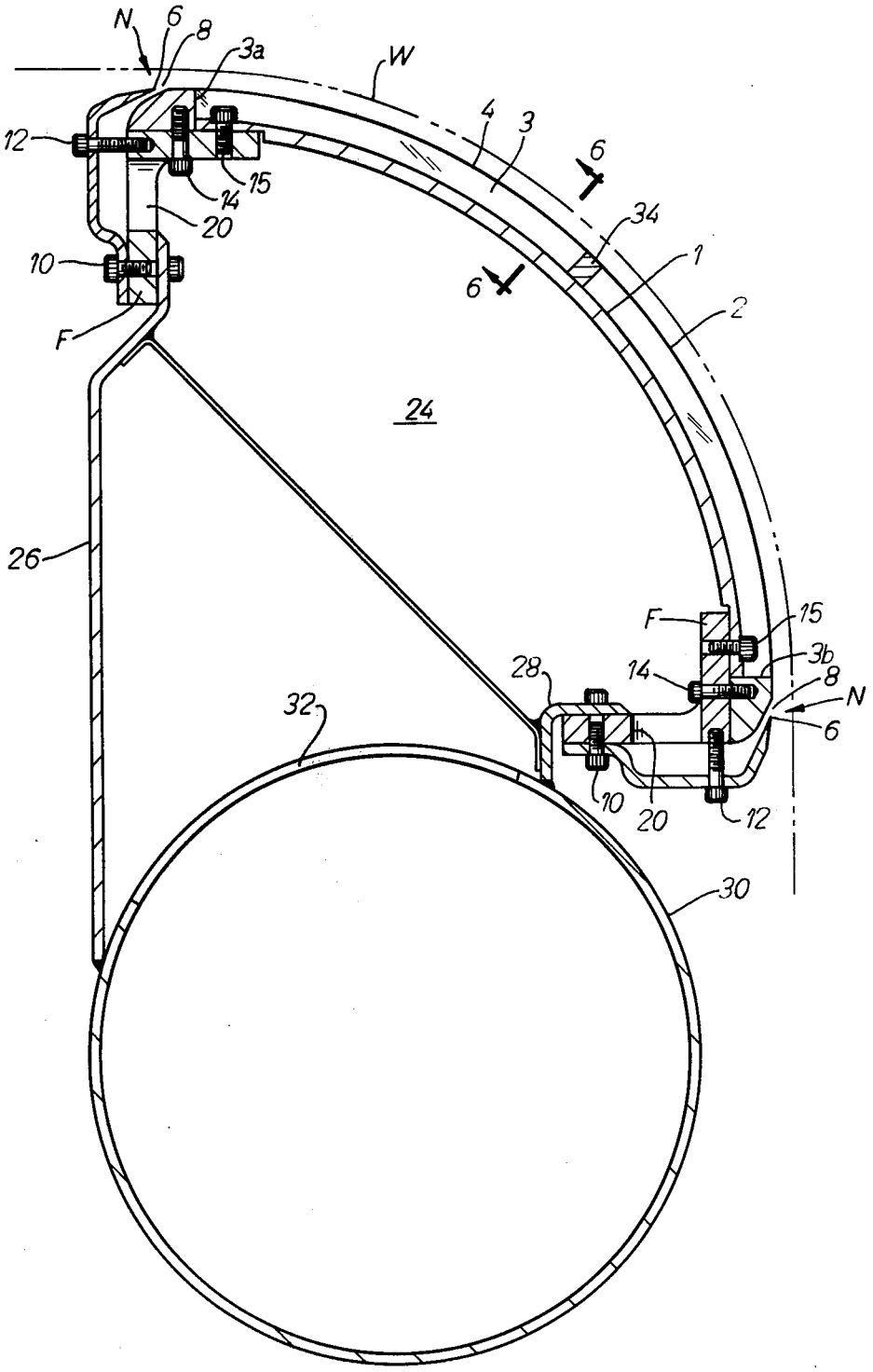
FIG. 3 is an enlarged, cross-sectional view through one of the supports shown in FIG. 2.
Figure 5:
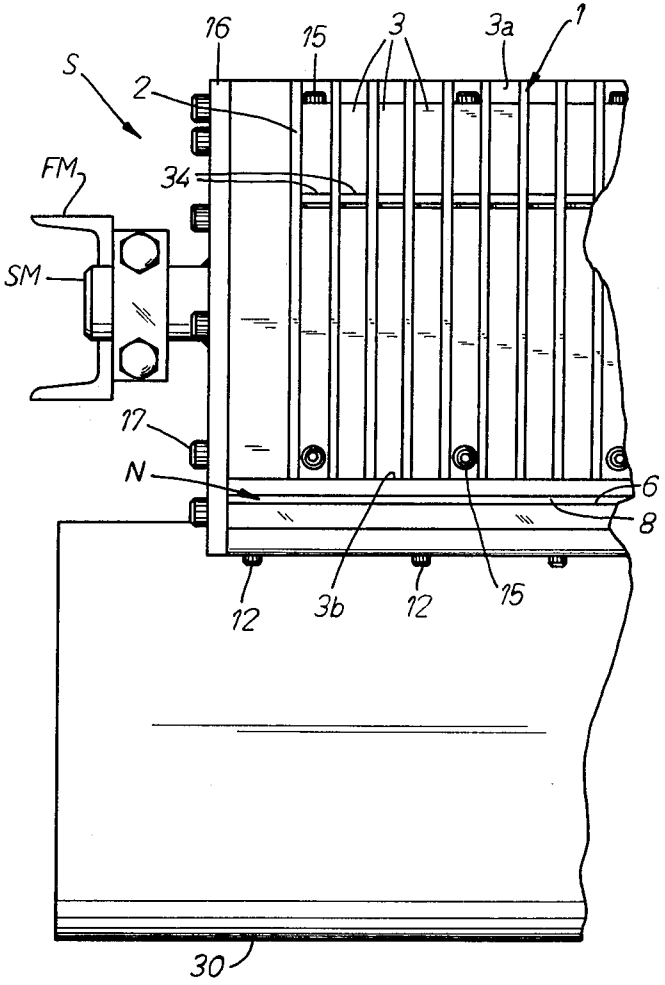
FIG. 5 is a fragmentary view of the supports shown in FIG. 4 and taken generally along the line 5—5 in FIG. 4.
Figure 4:
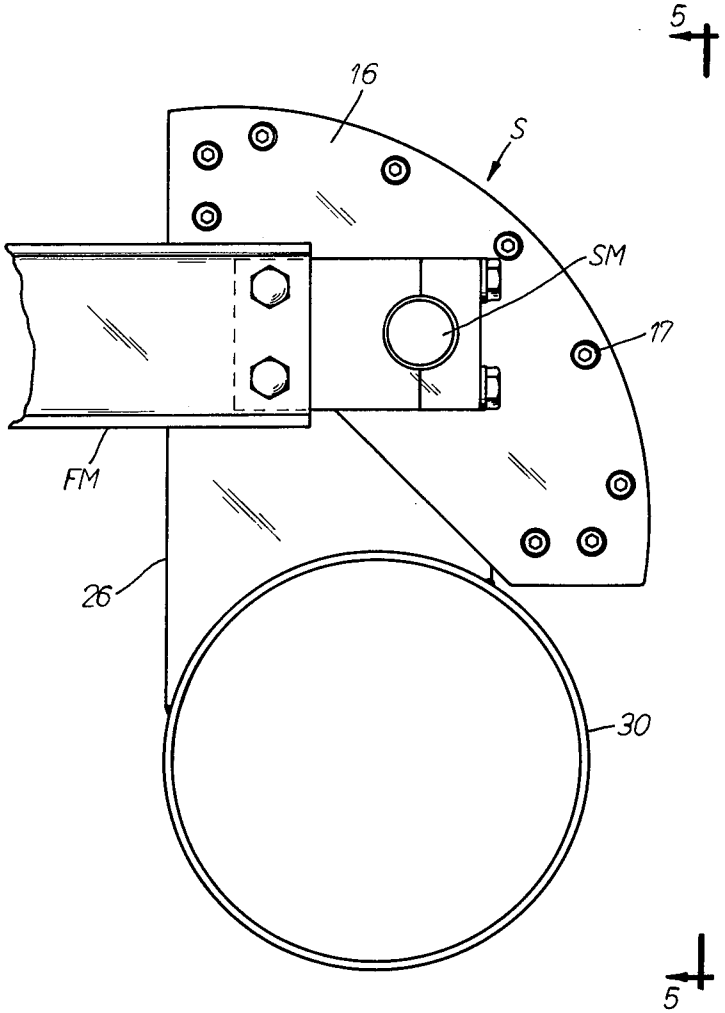
FIG. 4 is a side elevational view of one of the supports shown in FIG. 3 but on a reduced scale.
Figure 7:
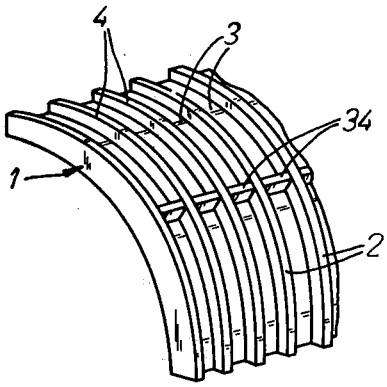
FIG. 7 is a fragmentary perspective view of a portion of the grooved arcuate surface shown, for example, in FIG. 2.
Figure 8:
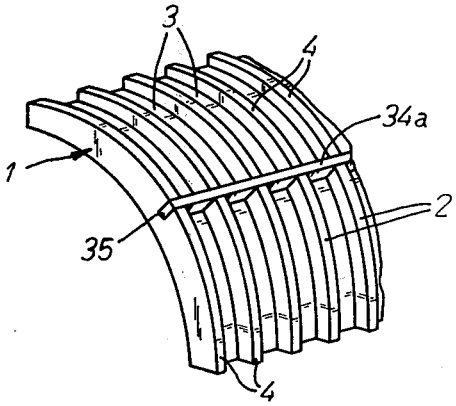
FIG. 8 is a view similar to FIG. 7 but showing a modification of the barrier in the grooved arcuate surface.

As shown in FIGS. 3, 5, 7, a barrier 34 extends transversely of the direction of the web travel and across the grooves 3 and blocks them intermediate their length to thereby form a barrier to the air flow in the grooves. The barrier 34 may be formed by being cast if the grooved arcuate support 1 is formed as a casting, or the barrier may be formed by individual pieces inserted in the grooves. Another alternative, as shown in FIG. 8, is to form the barrier from a strip of material 34*a* which is then inserted in an axial slot 35 that is cut through the circumferential ribs 4.

The barrier eliminates flow instability and prevents one slot from dominating the other which would otherwise result in a non-symmetrical air flow pattern, reduced cushion pressure, and non-uniform cushion pressure.

In operation, pressurized air is introduced between the arcuate support 1 and the web, thus forming a pressurized cushion therebetween which floatingly supports and guides the web as it passes over the arcuate surface 2. In practice, a clearance is maintained between the web and the arcuate surface 2 of the arcuate support member 1 and by the use of the spaced grooves in the arcuate surface and that extend longitudinally of the web, a labyrinth sealing action is provided which inhibits lateral or transverse flow of air out from the pressurized cushion. That is to say, flow of air towards the opposite edges of the web is inhibited and it has been found that with a web under a tension of four pounds per linear inch, the air flow required is about ten percent less and the air horsepower required is about 25 percent less than with a contactless support having a smooth surface, for the same operating conditions. Moreover, in some applications such as on printing presses, it is often desired to run webs of half the normal width. With the narrow web, the importance of end leakage is further increased.

I claim:

1. A contactless web support having an elongated arcuate surface and over which a running web is floatingly supported without contact therewith, a plurality of parallel grooves formed in said surface and extending around said arcuate surface and in a direction in which the web passes thereover, said grooves terminating in opposite ends, a pair of elongated nozzles extending along the length of said elongated arcuate surface, one nozzle located adjacent each of the ends of said grooves, said nozzles having discharge slots directed toward one another and over said arcuate surface, and means for supplying pressurized air to said nozzles to thereby form a fluid pressure zone between said arcuate surface and the web passing thereover, said parallel grooves forming labyrinth seals which inhibit transverse flow of air outwardly of the fluid pressure zone toward the edges of said running web.

2. The support set forth in claim 1 further characterized in that said nozzles are formed from a piece of sheet metal fabricated into a generally U-shaped section, one edge of said section acting to partially define said slot of said nozzle, and means for adjustably supporting said nozzle to thereby vary the width of said discharge slot.

3. The support set forth in claim 1 including a barrier extending in the transverse direction in respect to web travel and in said grooves and intermediate the length of said grooves to thereby form a barrier to the air flow in said grooves.

4. The support set forth in claim 3 further characterized in that said arcuate surface has a slot formed across said grooves and said barrier is a strip of material located in said slot.

5. The support set forth in claim 2 including a barrier extending in the transverse direction in respect to web travel and in said grooves and intermediate the length of said grooves to thereby form a barrier to the air flow in said grooves.

6. The support set forth in claim 5 further characterized in that said arcuate surface has a slot formed across said grooves and said barrier is a strip of material located in said slot.

7. A web support having an elongated arcuate surface and over which a running web is floatingly supported without contact, a plurality of generally parallel grooves formed in said surface of said support and extending around said arcuate surface in a web travel direction, said grooves terminating in opposite ends; a pair of elongated nozzles extending transversely across said arcuate surface, one nozzle located adjacent each of said ends of said grooves, each of said nozzles having a discharge slot directed toward the other and over said arcuate surface, said nozzles formed from a piece of sheet metal fabricated into a generally U-shaped cross section, one edge of said section acting to partially define said slot of said nozzle, means for adjustably supporting said nozzle to thereby vary the width of said discharge slot, means for supplying pressurized air to said nozzles to thereby form a fluid pressure zone between said arcuate surface and the web passing thereover, said parallel grooves forming labyrinth seals which inhibit transverse flow of air outwardly of the fluid pressure zone toward the edges of said running web, a slot formed across said arcuate surface and grooves and intermediate the length of said grooves, a strip of material located in said slot and forming a barrier to air flow in said grooves and extending in the transverse direction in respect to web travel.

* * * * *